US011280581B1

(12) United States Patent
Ollivier

(10) Patent No.: US 11,280,581 B1
(45) Date of Patent: Mar. 22, 2022

(54) STABILITY MAINTAINING RIFLE SLING

(71) Applicant: David T. Ollivier, Sicklerville, NJ (US)

(72) Inventor: David T. Ollivier, Sicklerville, NJ (US)

( * ) Notice: Subject to any disclaimer, the term of this patent is extended or adjusted under 35 U.S.C. 154(b) by 0 days.

(21) Appl. No.: 17/176,406

(22) Filed: Feb. 16, 2021

(51) Int. Cl.
*F41C 33/00* (2006.01)

(52) U.S. Cl.
CPC ..... *F41C 33/001* (2013.01)

(58) Field of Classification Search
CPC ..... F41C 33/00; F41C 33/001; F41C 33/002
USPC ..... 42/85, 90
See application file for complete search history.

(56) References Cited

U.S. PATENT DOCUMENTS 3,927,808 A * 12/1975 Steen ..... F41C 33/002 224/267
7,959,046 B2 * 6/2011 Burnsed, Jr ..... F41C 33/001 224/150
8,857,680 B1 * 10/2014 Thompson ..... F41C 33/001 224/150
9,328,992 B1 * 5/2016 Smith ..... F41C 33/001
2014/0290108 A1 * 10/2014 Nevils ..... F41C 33/001 42/1.06
2014/0346199 A1 * 11/2014 Golob ..... F41C 33/001 224/150
2016/0377371 A1 * 12/2016 Anthony ..... F41C 33/002 224/150
2020/0041227 A1 * 2/2020 Brock ..... F41C 33/002

* cited by examiner

*Primary Examiner* — Bret Hayes
(74) *Attorney, Agent, or Firm* — Stuart M. Goldstein

(57) ABSTRACT

A rifle sling has first and second adjustable sling members attached to each other by a side release buckle. The second sling member has two arm sections which extend upward from the first sling member. The lower end of the first sling member is attached to the shooter while the upper ends of the arm sections of the second sling member are attached one on each opposite side of the rifle.

13 Claims, 5 Drawing Sheets

STABILITY MAINTAINING RIFLE SLING

RELATED APPLICATION

This application claims the benefit of provisional application 63/075,589, filed on Sep. 8, 2020.

FIELD OF THE INVENTION

The present invention relates to a sling for a rifle or like weapon which provides stabilization to promote shooting accuracy.

BACKGROUND OF THE INVENTION

In precision shooting, whether it be tactical, competitive, or recreational, repeatability and consistency are essential to accurate shot placement. The most common problem in achieving these objectives is uneven tension which is applied to the rifle via a two-point sling. This tension pulls on one side of the handguard or chassis system of the rifle which in turn applies an uneven pulling force on the barrel nut and barrel. Any uneven pressure while shooting can cause minute changes that potentially result in large deviations downrange. This deviation depends on the distance of the target which is being engaged and the pressure being applied. Proper execution of the shooting fundamentals also plays into the accuracy of the shooter and the weapon system.

SUMMARY OF THE INVENTION

It is thus the object of the present invention to provide a sling, especially for, but not limited to, USMC M40A6, M110 SASS, and MK 13 sniper rifles, which addresses the common issue of improper and uneven tension while shooting these weapons. The sling of the present invention allows the military, law enforcement, and precision shooter to ensure for the accuracy required to take that effective shot which could win a match or potentially save a life.

These and other objects are accomplished by the present invention, a rifle sling having first and second length adjustable sling members removably attached to each other by a side release buckle. The second sling member has two arm sections which extend upward from the first sling member. The lower end of the first sling member is attached to the shooter while the upper ends of the arm sections of the second sling member are attached one on each opposite side of the rifle. This results in a three-point shooter to rifle attachment configuration which accomplishes even tension of the sling applied to the rifle for optimal sight alignment, sight picture, and stability while shooting the rifle from any position.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
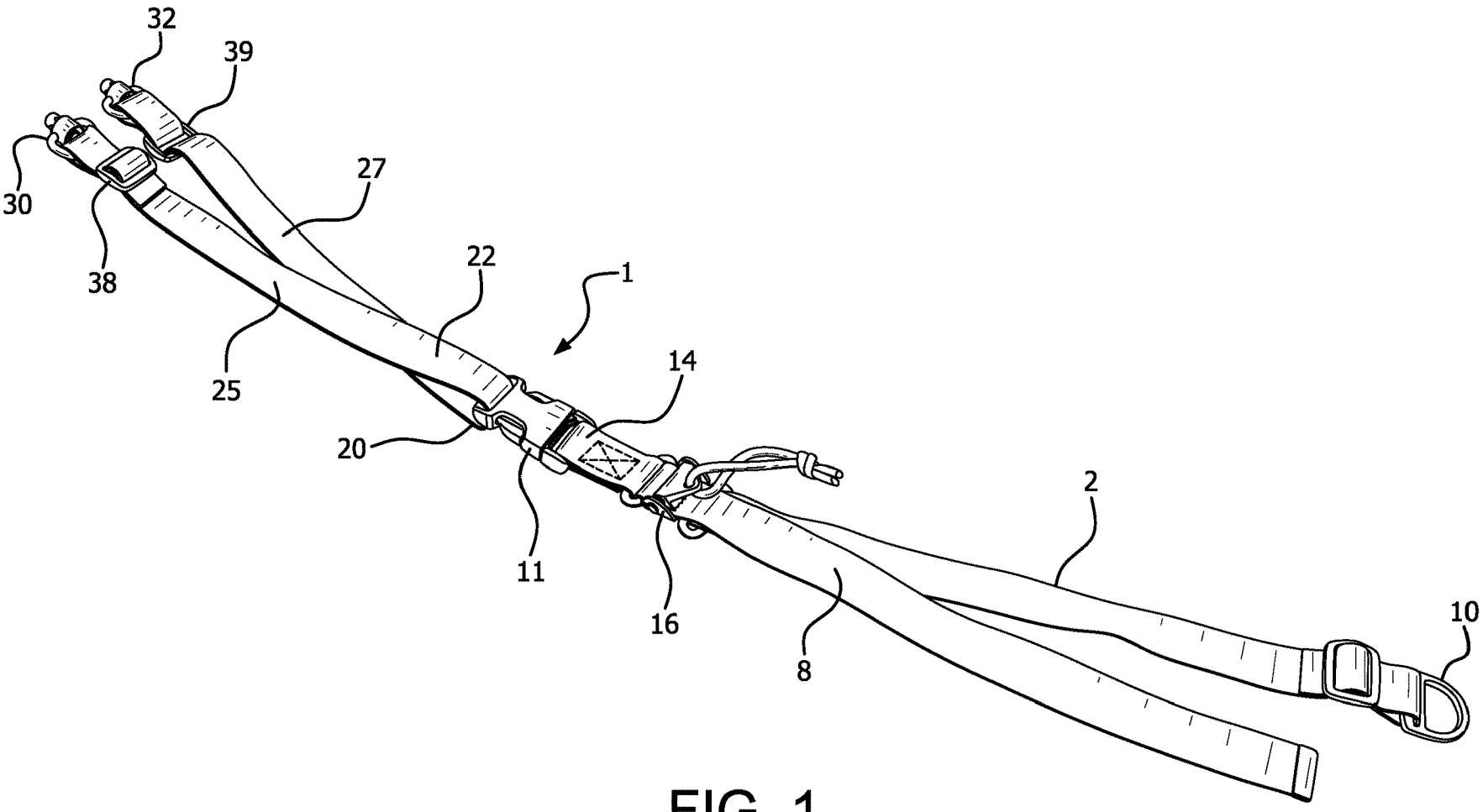
FIG. 1 shows the rifle sling of the present invention.
Figure 2:
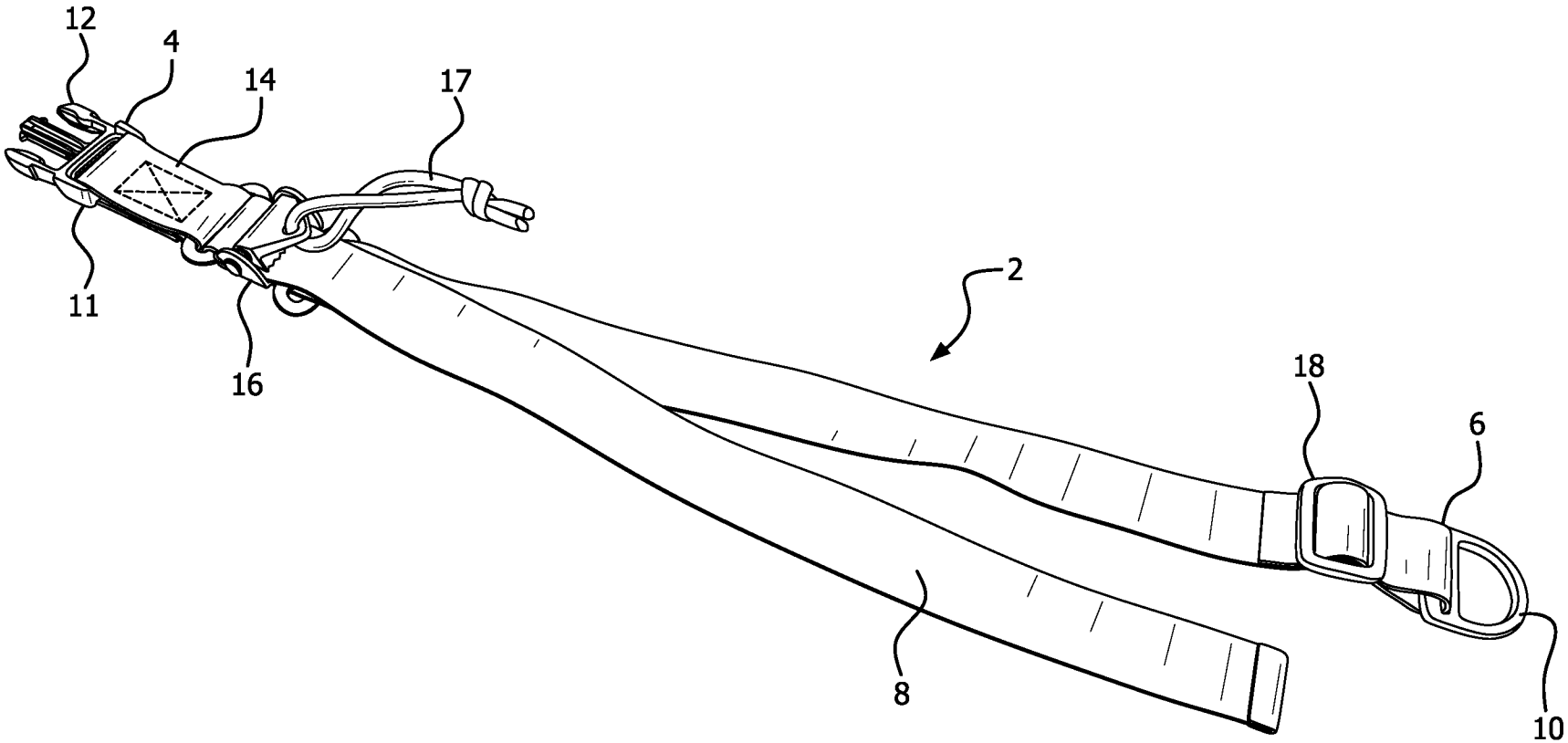
FIG. 2 shows the first sling member of the rifle sling of the present invention.
Figure 3:
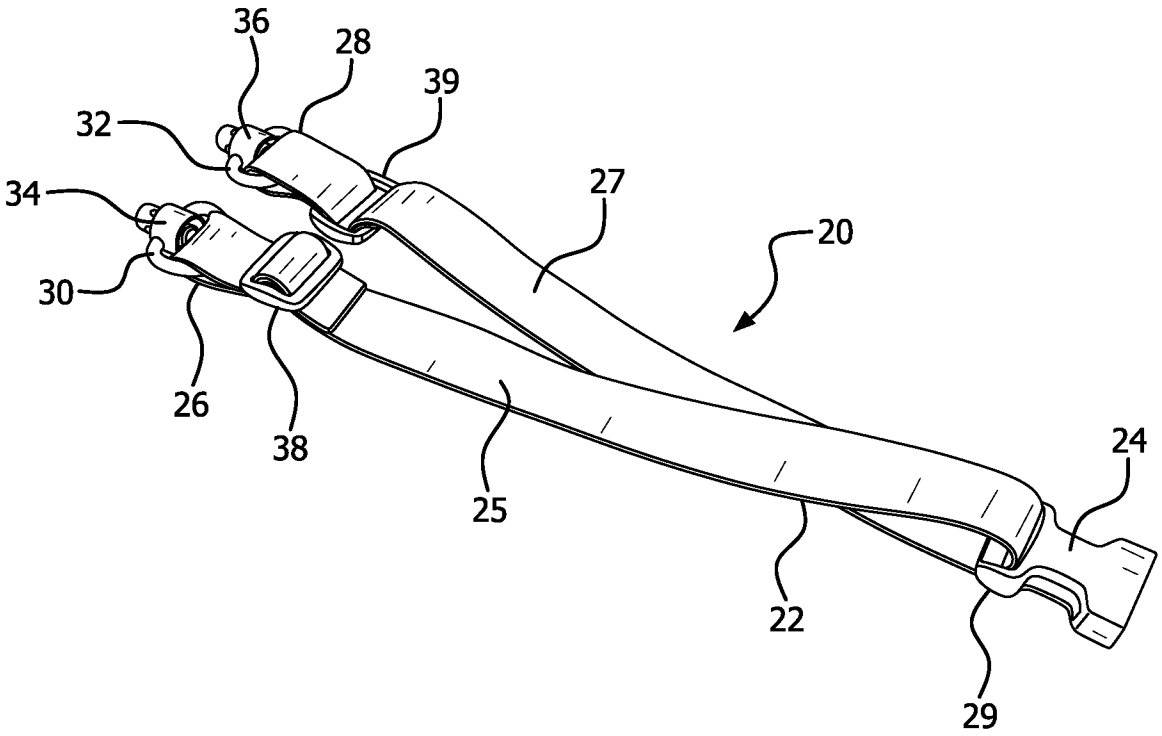
FIG. 3 shows the second sling member of the rifle sling of the present invention.

Rifle sling 1 comprises first sling member 2 having sling strap 8, doubled over and configured to form upper end 4 and lower end 6. Connection component 10 is a D ring positioned at and connected to lower end 6 of sling member 2. Second connection component 12, in the form of the male section of integral side release buckle 11, is positioned at and is connected to sling member 2 at upper end 4. Web section 14 is connected between second connection component 12 and quick release buckle 16, through which strap 8 extends. Lanyard 17 is connected to buckle 16. Strap 8 also extends through triglide ring 18. Buckle 16 and triglide ring 18 both serve as strap length and adjustment means. However, buckle 16 is the primary means by which strap 8 length is adjusted when sling 1 is in use, i.e. when it is connected between rifle 52 and shooter 50. Side release buckle 11 also serves as a quick release device, for prompt disconnection of sling 1 from rifle 52.

Second sling member 20 comprises sling strap 22 which extends through connection component 24, such that the second sling member is configured with strap arm sections 25 and 27 terminating at upper ends 26 and 28 respectively. Connection component 24 takes the form of the female section of integral side release buckle 11 and is positioned at lower end 29 of sling member 20. Sling strap 22 extends through dual connector components in the form of QD swivels or G hooks 30 and 32 at ends 26 and 28 of arm sections 25 and 27 of sling member 20. These QD swivels or G hooks attach to bipods or rifle QD cups 34 and 36 which secure second sling member 20 and hence sling 1 to rifle 52. Strap arm sections 25 and 27 also extend through triglide rings 38 and 39 respectively. These triglide rings serve as additional sling length adjustment means.

It is contemplated that sling straps 8 and 22 as well as web section 14 are to be made of 500 D Cordura webbing. Typical sizes for these components would be one inch wide webbing, with sling strap 2 being 36 to 42 inches in length, depending on the height of the shooter, sling strap 20 being 32 inches in length, and web section 14 consisting of a 3 inch piece of reinforced webbing. However, the invention is not to be deemed restricted to the type of strap material, component dimensions, or type and placement of the buckles disclosed herein. Any equivalent device, material or feature of that which is disclosed is contemplated by the present invention.

Figure 4:
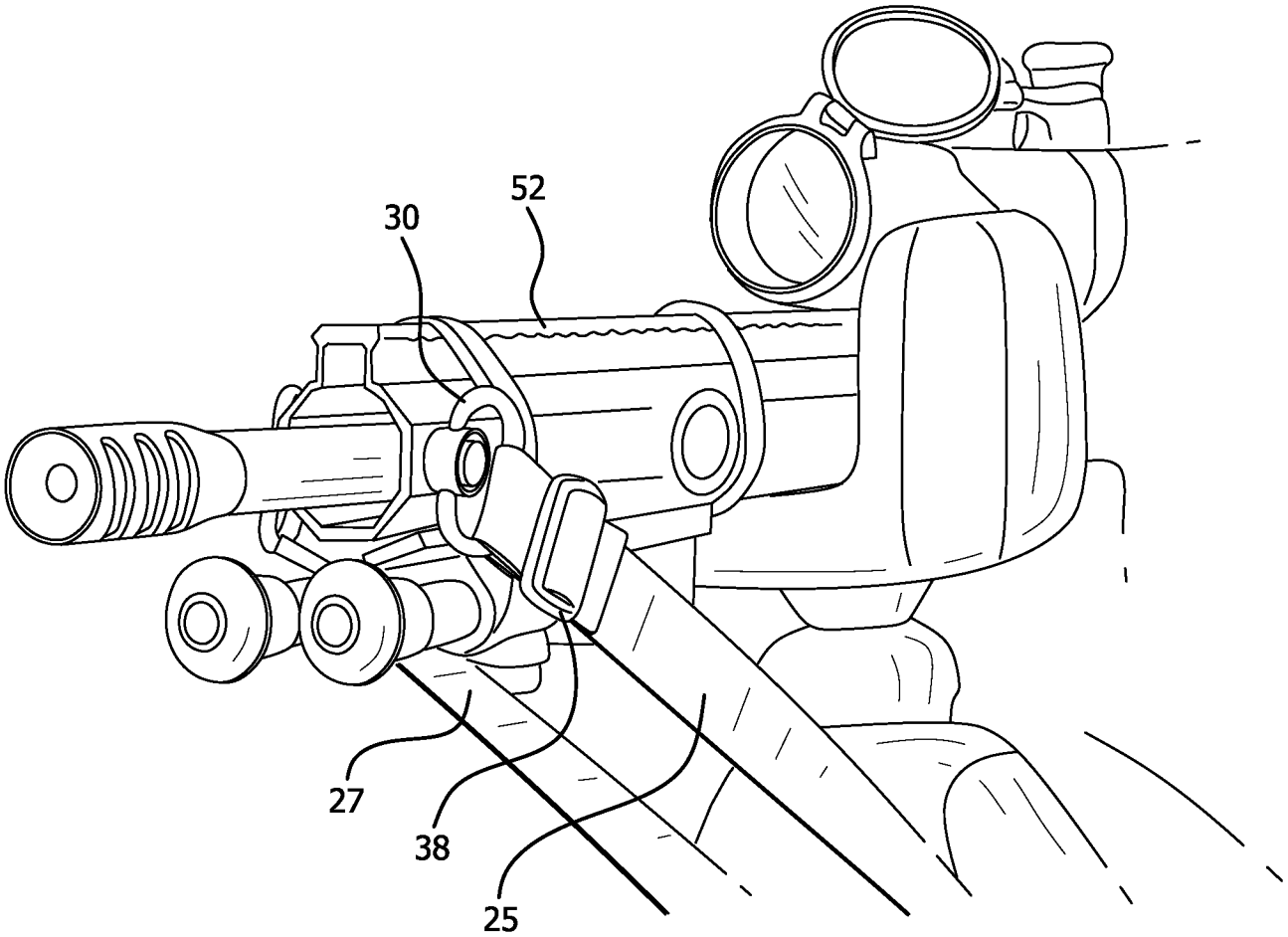
FIG. 4 shows the manner of connection of the rifle sling of the present invention to a rifle.
Figure 5:
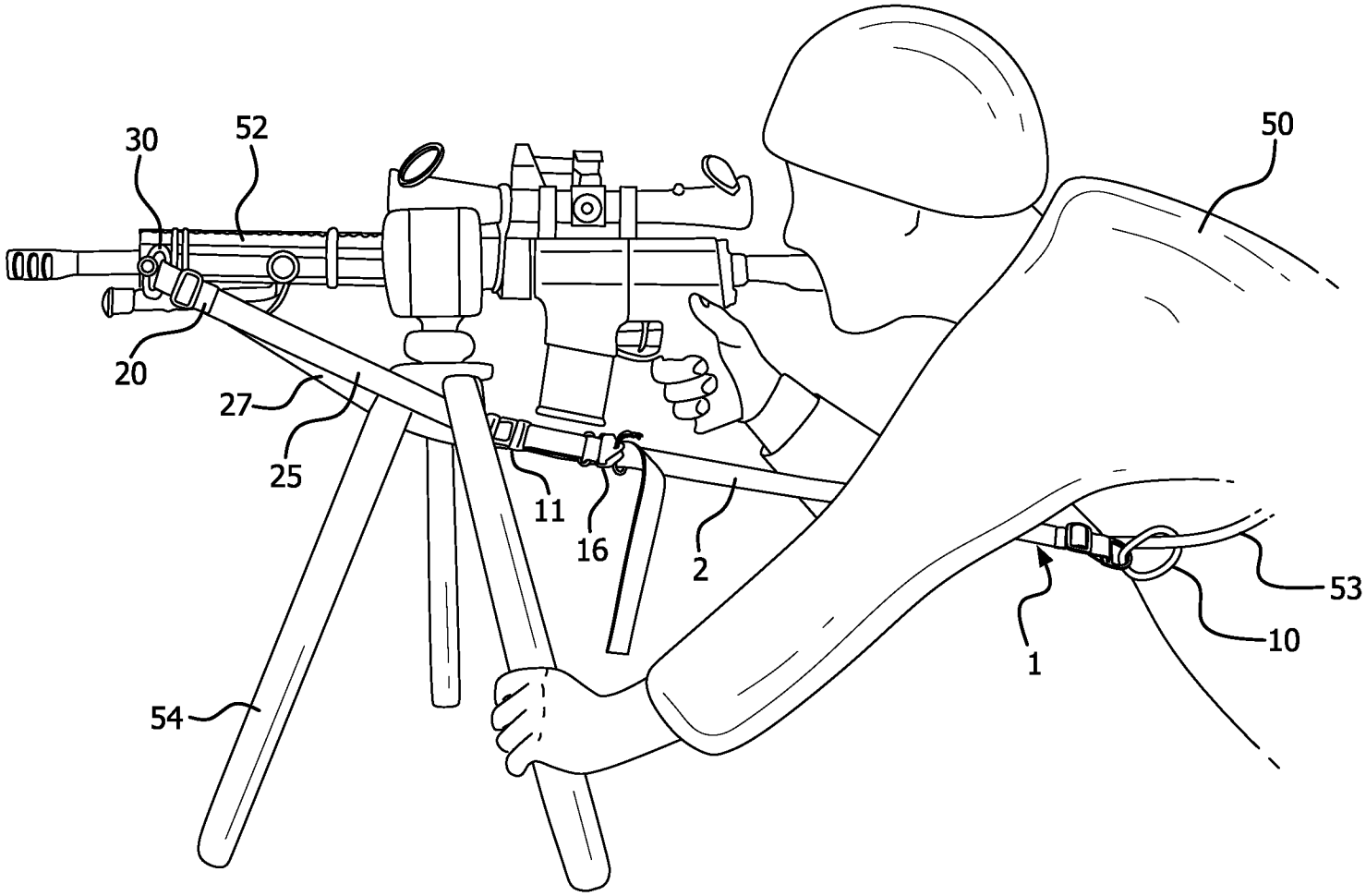
FIG. 5 illustrates the use of the rifle sling of the present invention.

The manner in which sling 1 is to be used is best illustrated in FIG. 5. Sling member 2 of sling 1 is attached to shooter 50 by means of D ring 10 connected to the shooter's belt 53 or other body-clad equipment. Sling member 20 is attached to sling member 2 by means of integral side release buckle 11. Arm sections 25 and 27 of sling member 20 are connected to opposite sides of rifle 52 via G hooks or QD swivels 30 and 32 and rifle QD cups 34 and 36, as also shown in FIG. 4. Triglide rings 18, 38, and 39 are set to initially fit the frame of shooter 50, with buckle 16 allowing the shooter to more precisely change the length of strap 8.

The use of sling 1 in this matter results in a three-point shooter to rifle configuration which allows the shooter to set the proper tension of the sling for optimum sight alignment, sight picture, and stability while shooting rifle 52 from any position, e.g. sitting, prone, kneeling and standing.

For best results, sling 1 is to be used with a tripod 54 or some other form of shooting support that will provide increased stability and hence optimal success when utilizing the sling.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A rifle sling which is configured to extend between a rifle and its shooter, said sling comprising:

a first sling member comprising a strap doubled over to form two separate strap arm branches, each strap arm branch having an upper end where the strap is doubled over and a lower free end, a first connector component attached to the lower end of one of the two arm branches for attaching the sling to the shooter and a second connector component extending from the upper ends of the two strap arm branches for attaching the first sling member to a second sling member, the first sling member having adjustment means for modifying the length of the strap and, wherein said second sling member comprises a strap doubled over to form two strap arm sections, each of the strap arm sections having a lower end where the second sling strap is doubled over and an upper end, and a third connector component at the lower end of the second sling member for attaching the second sling member to the second connector component, the two strap arm sections extending the length of the second sling member spanning continuously from the third connector component to dual connector components located on the upper ends of the strap arm sections of the second sling member for attaching the second sling member directly to opposite sides of the rifle.

2. The rifle sling as in claim 1 wherein the first connector component is a D ring and the second connector component is a male section of a side release buckle.

3. The rifle sling as in claim 1 wherein the third connector component is a female section of a side release buckle and the dual connector components are G hooks or QD swivels.

4. The rifle sling as in claim 3 wherein the first connector component is a D ring and the second connector component is a male section of a side release buckle.

5. The rifle sling as in claim 4 wherein the adjustment means comprises a quick release buckle.

6. The rifle sling as in claim 5 wherein the adjustment means comprises a triglide ring.

7. The rifle sling as in claim 6 further comprising a web member connected between the adjustment means and the second connector component.

8. The rifle sling as in claim 1 wherein the adjustment means comprises a quick release buckle.

9. The rifle sling as in claim 8 wherein the adjustment means further comprises a triglide ring.

10. The rifle sling as in claim 1 wherein the adjustment means comprises a triglide ring.

11. The rifle sling as in claim 1 further comprising a web member connected between the adjustment means and the second connector component.

12. A rifle sling which is configured to extend between a rifle and its shooter, said sling comprising:

a first sling member comprising two separate strap arm branches, each strap arm branch having an upper and a lower free end, a first connector component attached to the lower end of one of the two arm branches, and a second connector component extending from the upper ends of the two strap arm branches;

a second sling member comprising two separate strap arm sections, each of the strap arm sections having a lower end and an upper end, a third connector component at the upper end of each arm section, and a fourth connector component at the lower end of the second sling member for attaching the upper end of the first sling member to the lower end of the second sling member, the two strap arm sections extending the length of the second sling member spanning continuously from the third connector members to the fourth connector member;

wherein the first sling member is configured to be attached by the first connector component to the shooter and the second sling member is configured to be attached directly to the rifle by the third connector components, with one of the two strap arm sections attached to one side of the rifle and the other of the two strap arm sections attached to the opposite side of the rifle to establish a three point shooter to rifle attachment configuration, the three point configuration comprising the two points of attachment of the two strap arm sections directly to the rifle and the point of attachment of said one of the two arm branches to the shooter.

13. The rifle sling as in claim 12 wherein the first connector component is a D ring, the second connector component is the male section of a side release buckle, the third connector components are G hooks or QD swivels, and the fourth connector component is the female section of a side release buckle.

* * * * *